US005437138A

United States Patent [19]

Tuohey et al.

[11] Patent Number: 5,437,138

[45] Date of Patent: Aug. 1, 1995

[54] METHOD OF MAKING AND INSTALLING A RAIN GUTTER

[76] Inventors: Michael E. Tuohey, 604 6th St., Onawa, Iowa 51040; Carl J. Moore, 2934 Avenue B, Council Bluffs, Iowa 51501

[21] Appl. No.: 189,414

[22] Filed: Jan. 31, 1994

Related U.S. Application Data

[63] Continuation-in-part of Ser. No. 929,800, Aug. 13, 1992, abandoned.

[51] Int. Cl.[6] ..... E04B 1/00

[52] U.S. Cl. ..... 52/741.1; 52/11; 52/16; 52/745.21; 248/48.2

[58] Field of Search ..... 52/11, 12, 13, 14, 15, 52/16, 741.1, 745.21; 83/54; 29/414, 413; 156/293, 294, 305; 248/48.1, 48.2

[56] References Cited

U.S. PATENT DOCUMENTS

| | | | |
|---|---|---|---|
| 1,905,794 | 4/1963 | Burke | 52/220.1 |
| 3,216,875 | 11/1965 | Wenthe | 156/154 |
| 3,222,828 | 12/1965 | Kvan | 52/11 |
| 3,300,911 | 1/1967 | Riddell | 52/16 |
| 3,611,731 | 10/1971 | Edmondson | 61/14 |
| 4,553,356 | 11/1985 | Pepper | 52/11 |
| 4,672,084 | 6/1987 | Dierdorf et al. | 524/113 |
| 4,687,798 | 8/1987 | King et al. | 524/100 |
| 4,858,396 | 8/1989 | Rose et al. | 52/11 |
| 4,887,852 | 12/1989 | Hancock | 285/175 |
| 5,007,224 | 4/1991 | Segneri | 52/741 |

FOREIGN PATENT DOCUMENTS

| | | |
|---|---|---|
| 151451 | 6/1991 | Japan . |
| 992712 | 5/1965 | United Kingdom . |

*Primary Examiner*—Carl D. Friedman
*Assistant Examiner*—Kien Nguyen
*Attorney, Agent, or Firm*—Zarley, McKee, Thomte Voorhees & Sease; Mark D. Frederiksen

[57] ABSTRACT

A method of making and installing a rain gutter includes the step of providing a gutter of PVC material and attaching the gutter along the eaves of a structure to collect rain water draining from the roof of the structure. A downspout connector of PVC is attached to one end of the gutter utilizing a chemical welding process such that the PVC material in the connector and gutter fuse together to form a single integral piece. The connector is formed so as to redirect water draining from the gutter to a vertical direction, to thereby enter a downspout. Support brackets for the gutters are also manufactured of PVC, and attached to the gutter utilizing the chemical welding process, such that the support brackets become an integral part of the gutter. A special clamp is utilized to connect adjacent pieces during the chemical welding process to insure that the parts are fused together to form an integrated unit. In the preferred form out of the invention, conventional PVC pipes and various components are cut in half to form gutter lengths, T-shaped connectors, and elbows for use in the gutter system.

5 Claims, 6 Drawing Sheets

METHOD OF MAKING AND INSTALLING A RAIN GUTTER

CROSS-REFERENCE TO RELATED APPLICATION

This is a continuation-in-part application of Ser. No. 07/929,800 entitled METHOD OF MAKING AND INSTALLING A RAIN GUTTER filed on Aug. 13, 1992 now abandoned.

TECHNICAL FIELD

This invention relates generally to rain gutters and more specifically to a method of installing gutters utilizing conventional polyvinyl chloride (PVC) pipe.

BACKGROUND OF THE INVENTION

Most rain gutters along roofs and sidings of houses are composed of metal or metallic-like compounds that are subject to rusting and leaking. Metallic rain gutters are also vulnerable to freezing temperatures when water becomes trapped in the joints and crevices and expands upon freezing. The prior art method of installing metallic gutters is difficult in that each section must be fitted to correspond to the varying lengths of the eaves. This requires the laborious task of cutting and joining the metallic gutters. Repairing conventional gutters is burdensome and expensive, requiring replacement of an entire length of gutter when one small portion is damaged. In addition metallic rain gutters require a large number of support nails, and specifically require support at every joint.

SUMMARY OF THE INVENTION

It is therefore a principal object of the present invention to provide a method for installing a rain gutter that utilizes materials which prevent rusting, leaking, and is easily cut for any desired length.

A further object of the invention is to provide a method for repairing a rain gutter that utilizes a material which is easy to replace if repairs or modifications become necessary.

Yet another object of the invention is to provide a method of hanging a rain gutter of a material which is substantially self-supporting.

Still another object of the invention is to provide a method of constructing a gutter that utilizes a material which can be bonded together using a chemical welding process to form a single integral system to avoid the possibility of water lodging in crevices and joints of the pipes where freezing temperatures cause destruction of the pipes.

These and other objects of the present invention will be apparent to those skilled in the art.

The method of making and installing a rain gutter of the present invention includes the step of providing a gutter of PVC material and attaching the gutter along the eaves of a structure to collect rain water draining from the roof of the structure. A downspout connector of PVC is attached to one end of the gutter utilizing a chemical welding process such that the PVC material in the connector and gutter fuse together to form a single integral piece. The connector is formed so as to redirect water draining from the gutter to a vertical direction, to thereby enter a downspout. Support brackets for the gutters are also manufactured of PVC, and attached to the gutter utilizing the chemical welding process, such that the support brackets become an integral part of the gutter. A special clamp is utilized to connect adjacent pieces during the chemical welding process to insure that the parts are fused together to form an integrated unit. In the preferred form out of the invention, conventional PVC pipes and various components are cut in half to form gutter lengths, T-shaped connectors, and elbows for use in the gutter system.

DESCRIPTION OF THE PREFERRED EMBODIMENTS

Figure 1:
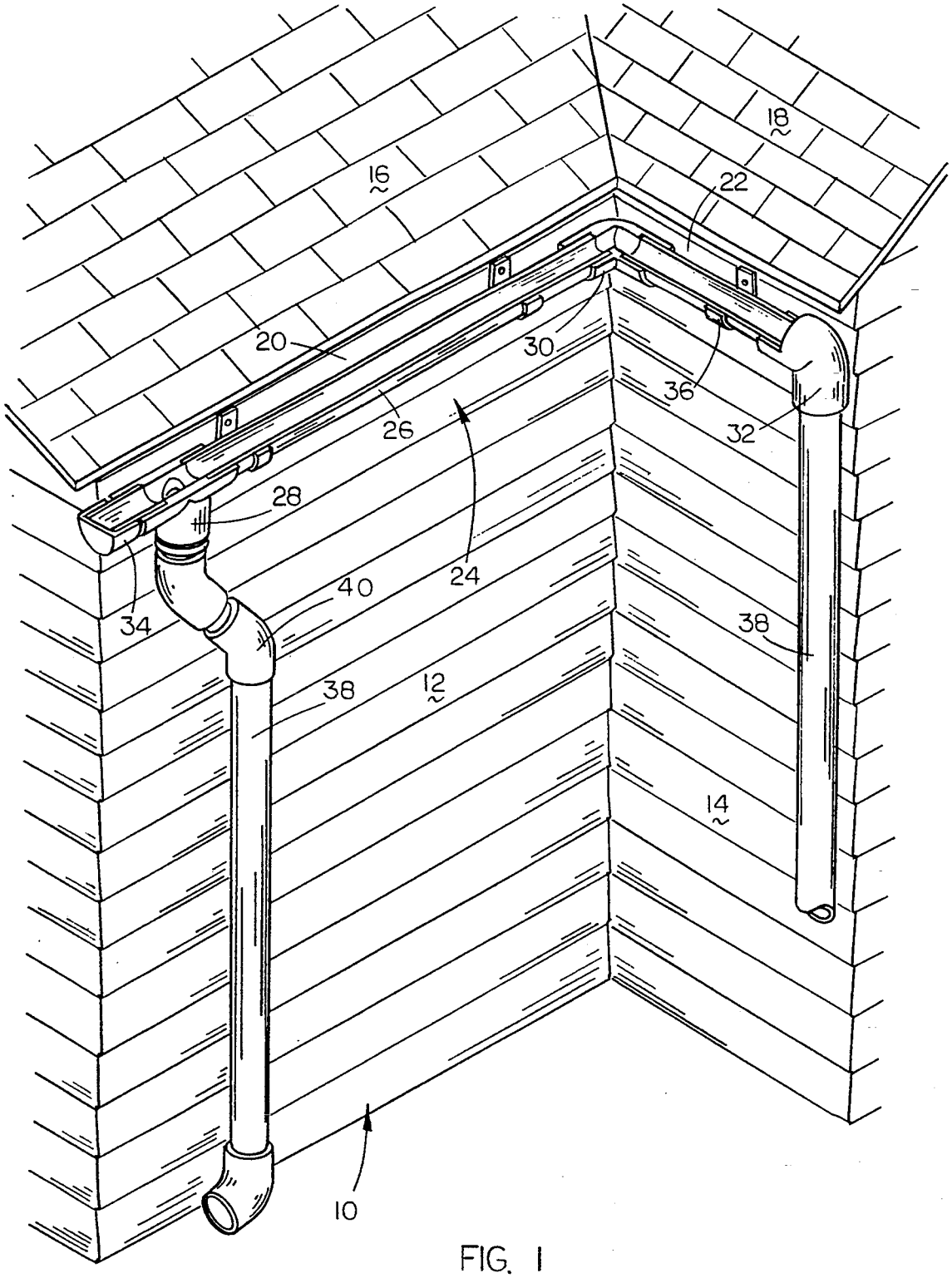
FIG. 1 is a perspective view showing the rain gutter of the present invention attached to the eaves of a roof.

Referring now to the drawings, in which similar or corresponding parts are identified with the same reference numeral, and more particularly to FIG. 1, a portion of a building 10 is shown with a first vertical wall 12 intersecting a second vertical wall 14. Walls 12 and 14 include in inclined roof 16 and 18 respectively, and an eaves 20 and 22 respectively.

The rain gutter system of the present invention is designated generally at 24 and includes a number of cooperable components, including: a generally horizontal length of gutter 26, a T-shaped connector 28, a modified elbow 30, an end elbow 32, an end cap 34, support brackets 36, and various conventional pipe members including pipe lengths 38 and elbows 40.

Figure 2:
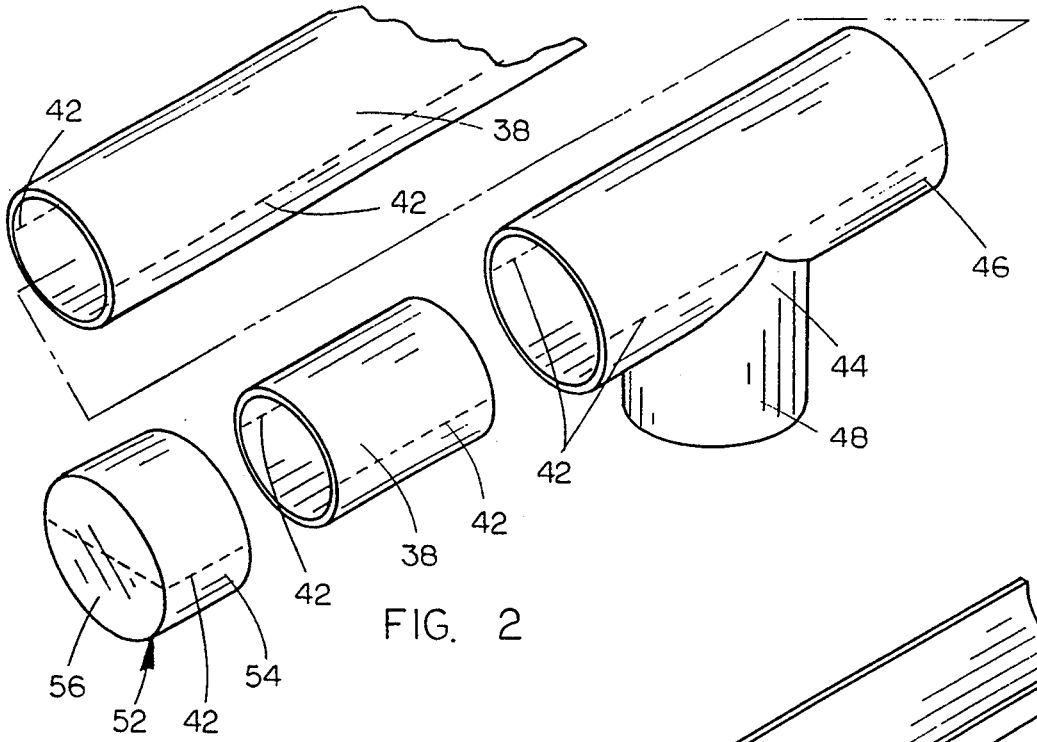
FIG. 2 is an exploded perspective view showing a T-shaped pipe connector, end cap and length of pipe prior to being cut lengthwise utilizing the method of this invention.

Referring now to FIG. 2, all of the various components of the rain gutter system of the present invention are manufactured from conventional polyvinyl chloride (PVC) type components. Throughout this application PVC should be understood to include all analogous materials, including, but not limited to: CPVC, PVCA, PVCCA, PVCV and PCWC. All such materials must have characteristics permitting a fusion of the materials together upon application of any commercially available PVC liquid fusion compounds, in a chemical welding process, to thereby form a single integrated unit after the parts have been chemically welded together.

Figure 3:
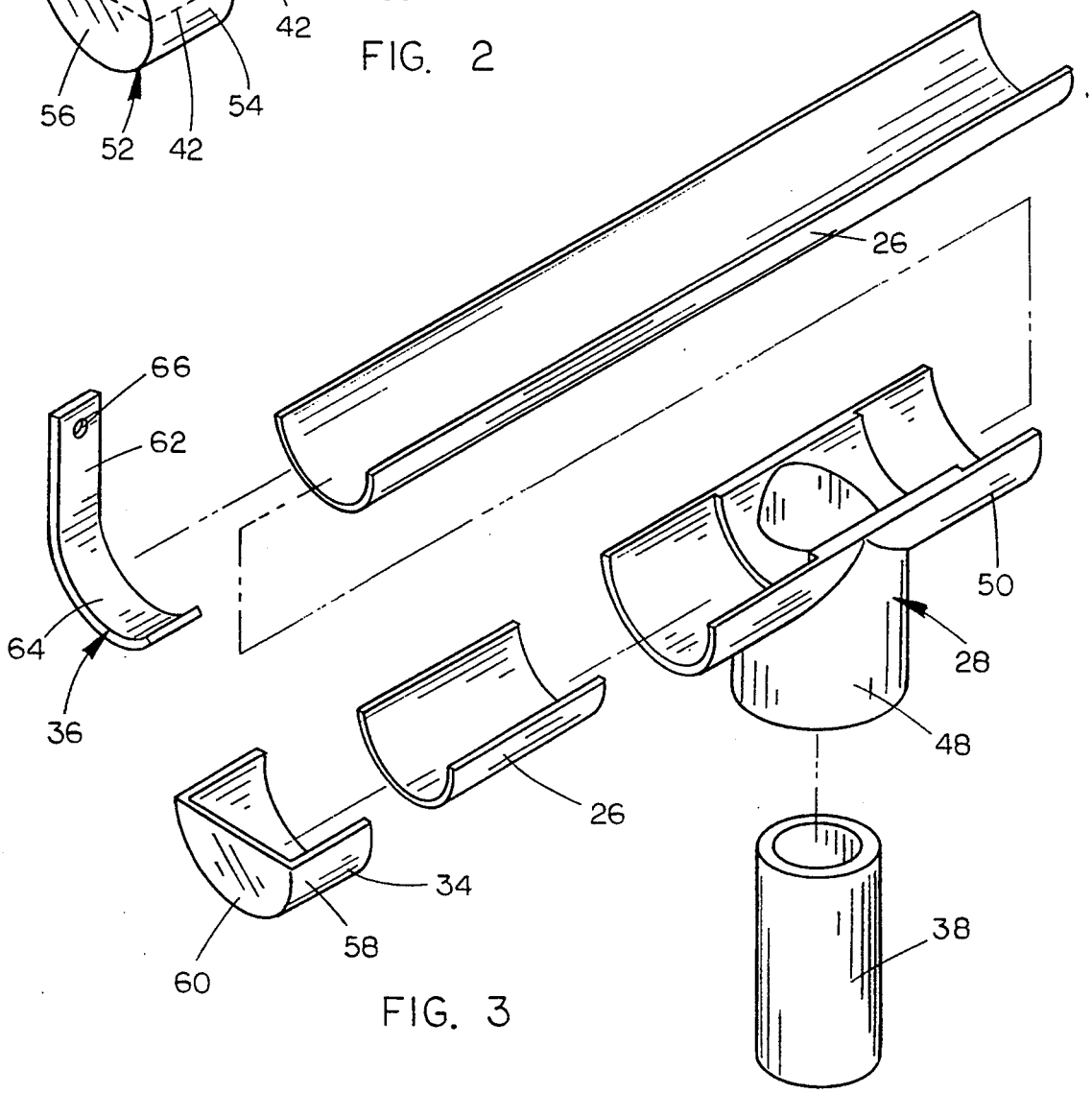
FIG. 3 is an exploded view similar to FIG. 2 after the pipe has been cut lengthwise forming the gutter and including a support bracket and connector for connecting a downspout.

In the preferred method of the invention, a conventional length of PVC pipe 38 is cut lengthwise, as indicated by dashed lines 42, to form a pair of identical gutters (one of which is shown in FIG. 3) having semi-annular cross-sections. Similarly, the T-shaped connector 28 (shown in FIG. 3) is formed from a conventional T-shaped pipe section 44 having a horizontal pipe section 46 with a depending stem pipe section 48 in fluid communication therewith. The horizontal pipe section 46 is cut lengthwise at dashed lines 42 to form a short gutter section with a semi-annular cross-section, and a lower T-shaped pipe connector with a semi-annular horizontal section 50, as shown in FIG. 3. The gutter end caps 34 are formed from a pipe cap 52 having a hollow cylindrical portion 54 and a circular end wall 56. Cap 52 is cut in half along dashed lines 42 so as to form two identical end caps having a semi-annular gutter portion 58 and a semicircular end wall 60, as shown in FIG. 3.

Figure 6:
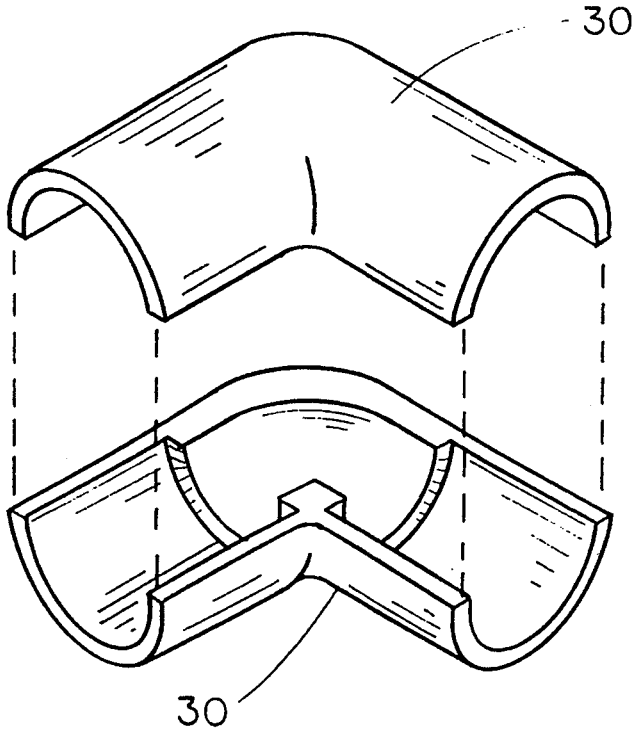
FIG. 6 is a perspective view of a modified elbow used for connecting two gutter lengths.

Modified elbow 30 is shown in FIG. 6 and is formed from a conventional elbow by cutting the elbow in half to form two identical modified elbows 30 with semi-annular cross-sections.

Figure 8:
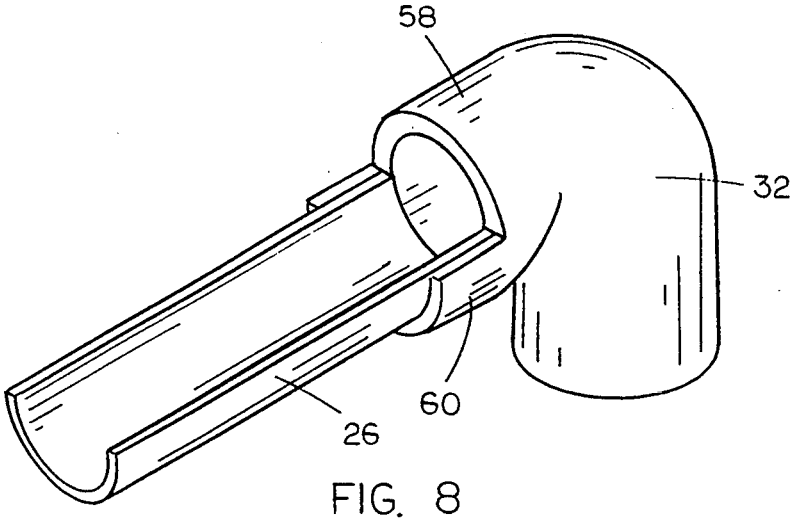
FIG. 8 is a perspective view of an elbow mounted to form a downspout junction with a gutter end.

FIG. 8 shows an end elbow 32 which has only been modified by removing a short semi-annular section from one leg 58 of the elbow 32. This forms a lower short semi-annular section 60 for supporting the end of a gutter 26.

Figure 7:
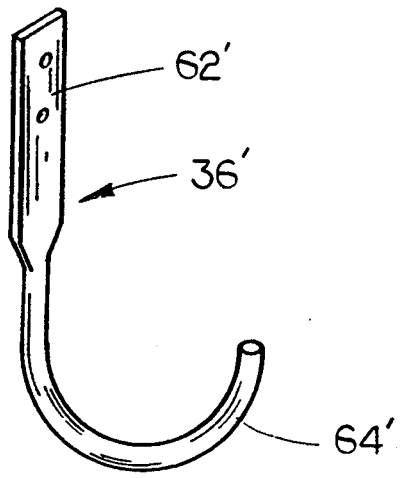
FIG. 7 is a perspective view of a second embodiment of a support bracket.

T-Shaped connector 28, as shown in FIG. 3, serves to connect a horizontal gutter 26 to a downspout 38. A short length of gutter 26 and an end cap 60 may then be fastened to one end of T-shaped connector 28 to complete the length of gutter. In the alternative, an end elbow 32 could be utilized, as shown in FIGS. 1 and 7, at the end of a length of gutter 26, to directly drain water from the gutter to a downspout.

Figure 4:
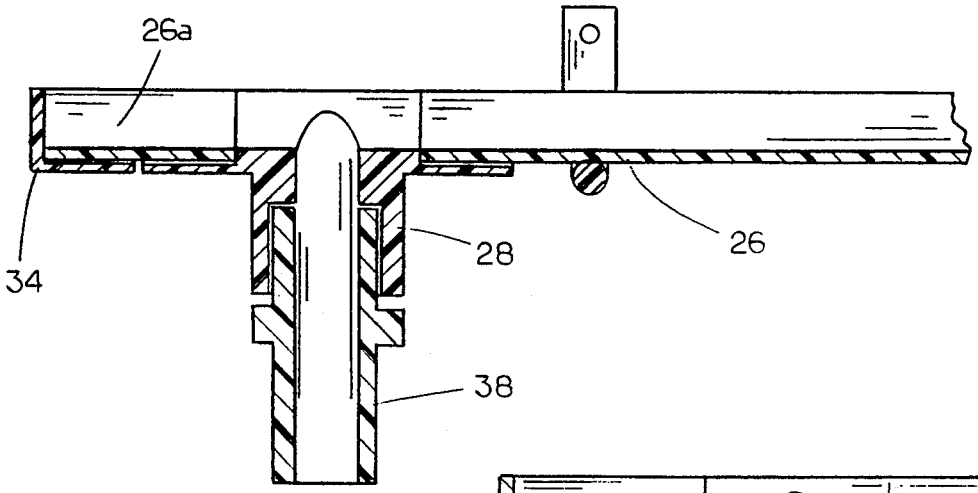
FIG. 4 is a vertical cross-sectional view of the junction of the downspout to the gutter.
Figure 5:
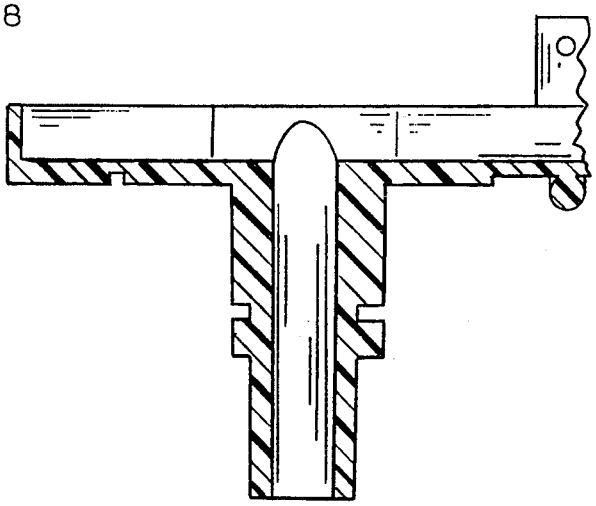
FIG. 5 is a similar view to FIG. 4 after the fusion of the surfaces of the separate pieces.

FIGS. 4 and 5 demonstrate one of the benefits of utilizing PVC pipe for the rain gutter system of the invention. FIG. 4 shows a gutter section 26 arranged with a T-shaped connector 28, downspout 38, end cap 34 and short gutter section 26*a*, assembled prior to application of fixative. Use of a chemical welding process to connect the various components provides a result which is not obtainable utilizing conventional metal or vinyl gutter systems. As shown in FIG. 5, the liquid fusion compound actually fuses all of the components together into a single integrated piece. Thus, no cracks or leaks are possible because of this weld between the various components. This connection method also enhances the stability and structural integrity of the entire gutter system to increase its self-supporting characteristics. For this reason, only a very few support brackets 36 are necessary to support the entire gutter system on the eaves of a structure.

Figure 9:
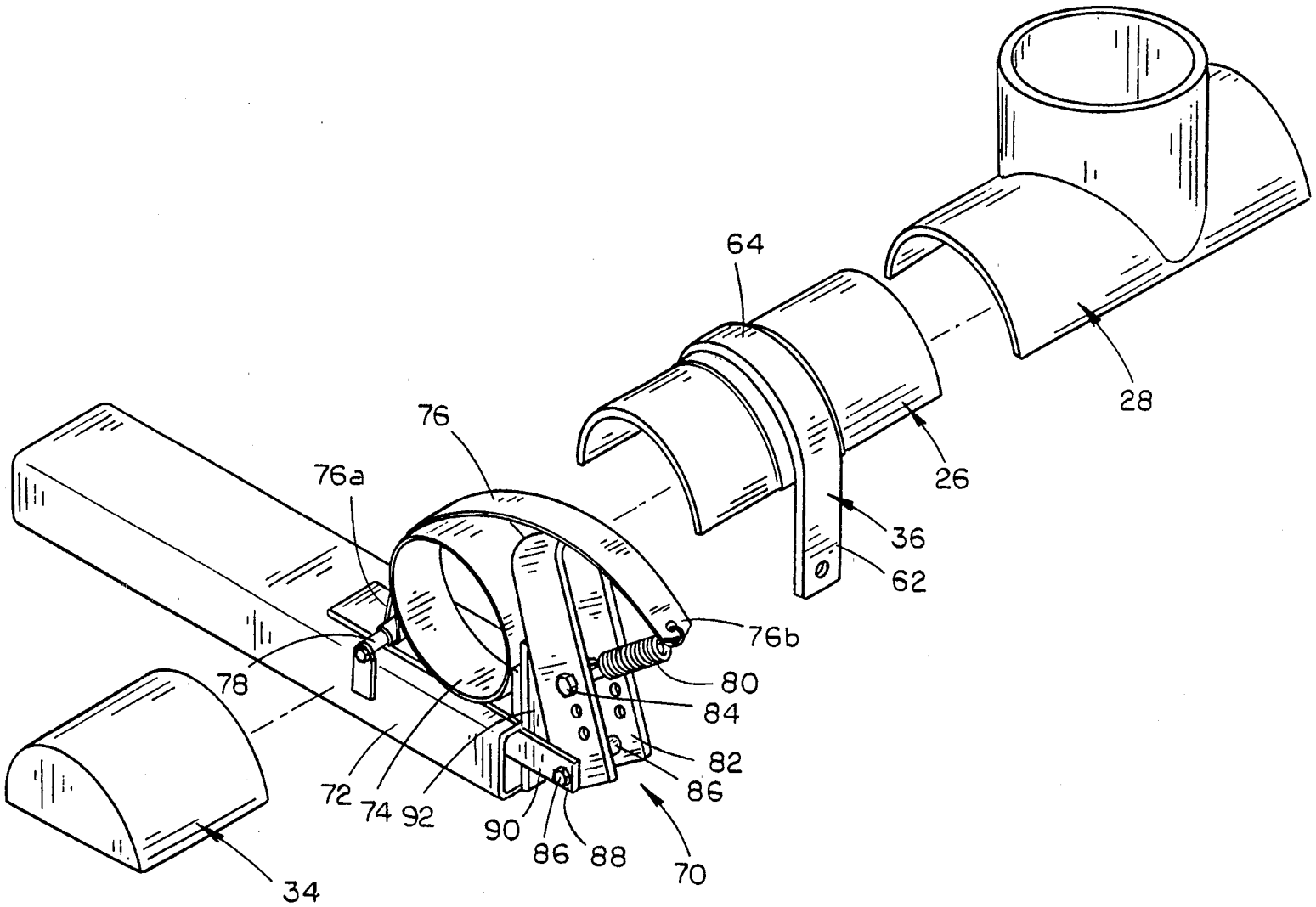
FIG. 9 is a perspective view of a special clamping mechanism utilized to assist in the construction of the gutter of the present invention.
Figure 10:
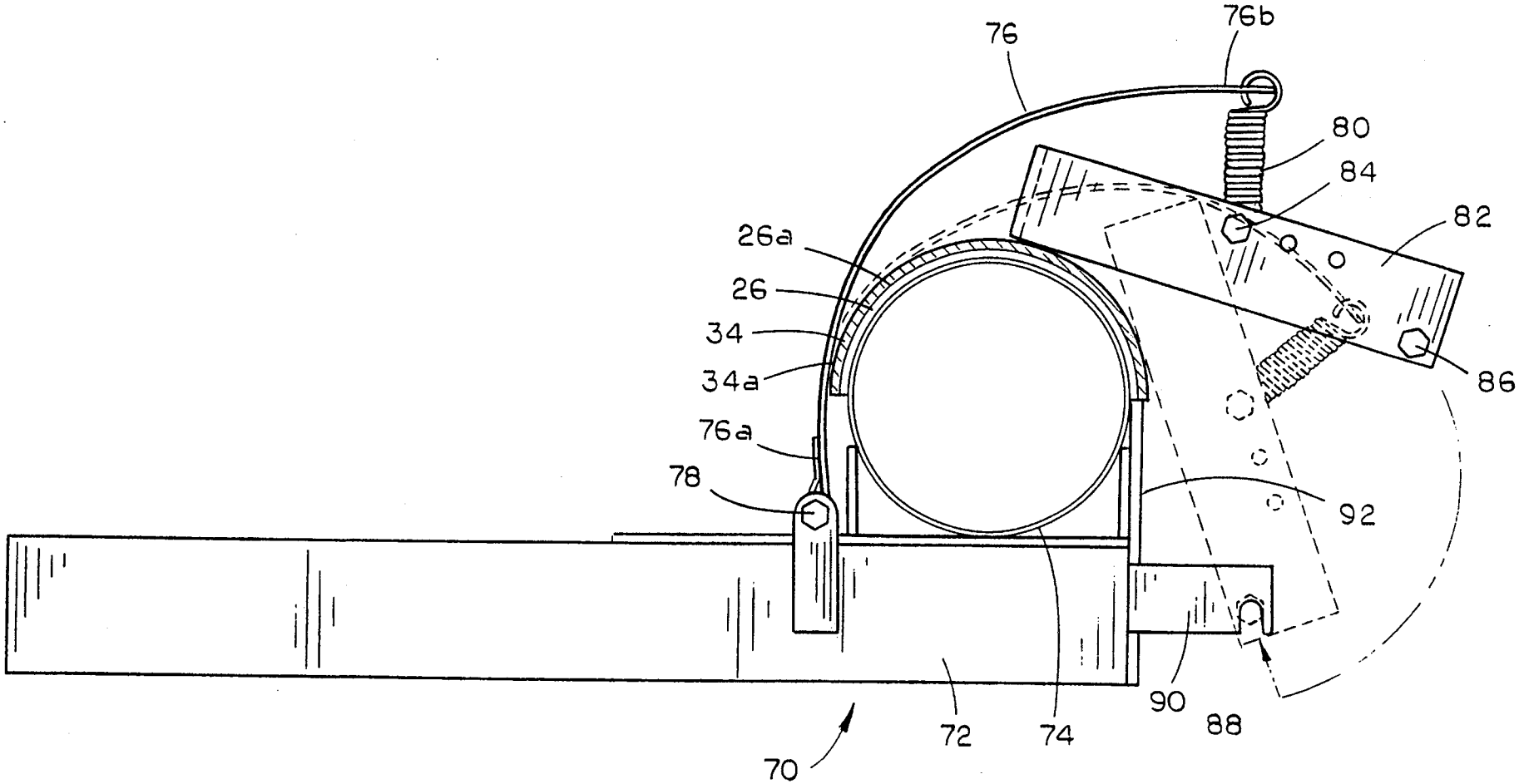
FIG. 10 is a side elevational view of the clamp mechanism taken from the left side of FIG. 9.

Referring now to FIGS. 9 and 10, a clamp apparatus 70 is shown which is utilized in the method of the present invention to connect various components during the chemical welding process. Clamping apparatus 70 includes a base 72 with a cylindrical support member 74 mounted on the upper end thereof. Cylindrical support member 74 has a radius equal to the interior radius of the gutter section 26. A flexible strap 76 is pivotally connected at one end 76*a* to a pin 78 on the top surface of base 72. The opposing end 76*b* of strap 76 is connected to one end of a spring 80 which is connected at the other end to a handle 82. Spring 80 is pivotally connected to a pin 84 mounted generally centrally on handle 82, and permits a biasing force to be applied to strap 76.

Handle 82 has a projecting pin 86 mounted at the lower end which is removably received in a slot 88 in a projecting arm 90 on base 72, as shown in FIG. 10.

In operation, one end of a section of gutter 26 is inverted and fitted upon the upper portion of cylindrical support member 74. A liquid fusion compound is then applied to the outer surface 26*a* of gutter section 26 and one end of an end cap 34 is placed on top of the portion of gutter 26 with the fusion compound thereon. Handle 82 is then lowered to engage pin 86 in slot 88, thereby biasing a portion of strap 76 onto the outer surface 34a of end cap 34, thereby squeezing the two gutter components together while the fusion compound cures in the chemical welding process. Once completely set, handle 82 is released by removing pin 86 from slot 88 such that the integral unit comprised of gutter 26 and cap 34 may be removed.

While this method was described with respect to a gutter section 26 and an end cap 34, obviously the same clamping mechanism may be utilized to clamp any two separate components during the chemical welding process.

Clamping apparatus 70 may also be utilized in affixing a J-shaped support bracket 36 to a portion of a gutter section 26, as shown in FIG. 9. In order to insure that the stem portion 62 is oriented vertically relative to the gutter section 26, a vertical plate 92 is mounted to the end of base 72 and projects vertically upwardly to a position tangent cylindrical support member 74, as shown in FIGS. 9 and 10. In this way, stem portion 62 will be aligned in abutting contact with plate 92 while the curved leg 64 is clamped in position by strap 76 in clamping apparatus 70.

Referring once again to FIG. 3, the support bracket 36 of the present invention is preferably manufactured from PVC, so that all components of the rain gutter system of the present invention may be chemically welded together using the same fusion compound. Bracket 36 is generally J-shaped with a generally vertical stem 62 and arcuate leg 64. Stem 62 has an aperture 66 at the upper end thereof for receiving a galvanized decking or sheet metal screw or the like to fasten the bracket on the eaves of the roof. Leg 64 is curved to a radius which matches the outer diameter of the gutter 26, to provide a firm support which contacts the entire outer surface of the gutter 26.

As shown in FIG. 7, a second embodiment of a bracket is identified generally at 36', and also includes a vertical stem 62' and an arcuate leg 64'. Bracket 36' differs from bracket 36 in that leg 64' has a circular cross-section. Preferably, leg 64' is bent to a radius slightly less than that of the outside diameter of the gutter 26, so that the gutter 26 will fit snugly within the curvature of the leg 64'.

Because the rain gutter system 24 of the present invention is manufactured from conventional PVC pipe components, any damage to the rain gutter system may be easily repaired by cutting out the damaged section and chemically welding a new length of gutter therein to replace the damaged section. Since the joints of the repair are fused during the repair process, the rain gutter system will not leak, even where repaired or where joints occur, and the entire repaired gutter system will have the same strength as the original integral unit.

In addition, PVC is a relatively rigid material which is structurally self-supporting, thereby reducing the number of brackets necessary to support the roof gutter system on the house. In the same way, a downspout need not be clamped or fastened to the house, since none of the joints will separate by virtue of gravity. The chemical welding of the various components gives the downspouts and related joints great structural integrity.

Use of PVC pipe, also permits the use of any conventional off-the-shelf PVC pipe component in installing the rain gutter system. Thus, a plurality of downspouts can be interconnected utilizing a "Y" connector or other connectors. Similarly, different diameters of pipe may be utilized by inserting an off-the-shelf adapter between the various components of the rain gutter system.

Whereas the invention has been shown and described in connection with the preferred embodiment thereof, it will be understood that many modifications, substitutions and additions may be made which are within the intended broad scope of the appended claims. There has therefore been shown and described an improved method for making and installing rain gutter which accomplishes at least all of the above stated objects.

We claim:

1. A method of making and installing a rain gutter for collecting and funneling water away from the roof of a structure, comprising the steps of:

providing polyvinyl chloride (PVC) pipe of a predetermined inner diameter and length;

cutting said pipe lengthwise in half to form two identical gutter lengths having semi-annular cross-sections, said gutter lengths having an inner surface, an outer surface, and two opposing ends;

providing generally J-shaped brackets of PVC for supporting said gutter lengths, said brackets having a vertical stem portion and an arcuate leg portion with an upper support surface;

chemically welding a plurality of brackets to the gutter lengths at spaced-apart locations with the stem portion projecting vertically upwardly from the gutter lengths; and attaching the stem portions of said brackets to the roof eaves with the inner surface of the gutter lengths directed upwardly, for collecting water draining from the roof.

2. The method of claim 1 further comprising the steps of:

providing a PVC T-shaped pipe connector having a horizontal pipe section of predetermined diameter and length and a vertical stem section of predetermined diameter and length depending therefrom and in fluid communication therewith;

cutting said horizontal pipe section of said T-shaped pipe connector lengthwise in half to form a semi-annular horizontal pipe section and a T-shaped gutter connector with a semi-annular horizontal section; chemically welding one end of the horizontal section of said T-shaped gutter connector to an end of said gutter length, to drain water from said gutter through said connector stem.

3. The method of claim 2, wherein the step of chemically welding one end of the T-shaped gutter to an end of said gutter length includes the steps of:

(a) applying a liquid PVC solvent to a portion of the outer surface of said gutter length end;

(b) positioning the inner surface of the T-shaped gutter end on the liquid solvent;

(c) clamping the T-shaped gutter end to the gutter length end so as to apply pressure between the T-shaped gutter inner surface and gutter length outer surface; and (d) releasing the clamping pressure after a predetermined amount of time.

4. The method of claim 1 further comprising the steps of:

providing a PVC pipe cap of a predetermined diameter and length and having a circular end wall; and cutting said cap lengthwise in half to form a pair of identical end caps having semi-annular cross-sections and a semi-circular end wall;

chemically welding at least one of said end caps to an end of said gutter.

5. The method of claim 1, wherein the step of chemically welding said brackets to said gutter lengths includes the steps of:

(a) applying a liquid PVC solvent to the upper support surface of a bracket leg portion;

(b) positioning the bracket at a predetermined location on a gutter length, with the solvent contacting the outer surface of the gutter length and the bracket stem portion oriented vertically relative to the gutter length;

(c) clamping the bracket to the gutter length so as to apply pressure between the bracket upper support surface and the gutter outer surface;

(d) releasing the clamping pressure after a predetermined amount of time; and (e) repeating steps (a), (b), (c) and (d) for each bracket.

* * * * *